US007887299B2

(12) United States Patent
Xiao

(10) Patent No.: US 7,887,299 B2
(45) Date of Patent: Feb. 15, 2011

(54) ROTARY BODY FOR TURBO MACHINERY WITH MISTUNED BLADES

(75) Inventor: Xinwen Xiao, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 894 days.

(21) Appl. No.: 11/759,705

(22) Filed: Jun. 7, 2007

(65) Prior Publication Data

US 2008/0304972 A1 Dec. 11, 2008

(51) Int. Cl.
*F01D 5/10* (2006.01)

(52) U.S. Cl. ..... 416/203; 416/234; 416/500

(58) Field of Classification Search ..... 416/203, 416/219 R, 234, 500
See application file for complete search history.

(56) References Cited

U.S. PATENT DOCUMENTS 2,957,675 A * 10/1960 Mason et al. ..... 416/220 R
3,847,506 A * 11/1974 Straniti ..... 416/244 R
3,867,069 A * 2/1975 Bussell ..... 416/212 R
4,062,638 A * 12/1977 Hall, Jr. ..... 416/244 A
4,084,922 A * 4/1978 Glenn ..... 416/220 R
4,097,192 A 6/1978 Kulina
4,536,932 A 8/1985 Athey
4,813,850 A * 3/1989 Partington ..... 416/219 R
4,878,810 A 11/1989 Evans
5,474,421 A 12/1995 Rossmann
5,540,551 A 7/1996 Heinig
5,735,673 A * 4/1998 Matheny et al. ..... 416/223 A
6,375,428 B1 4/2002 Stangeland et al.
6,379,112 B1 4/2002 Montgomery
6,752,594 B2 6/2004 Miller et al.
7,097,422 B2 8/2006 Rice et al.
7,147,437 B2 12/2006 Burdgick et al.

* cited by examiner

*Primary Examiner*—Ninh H Nguyen
(74) *Attorney, Agent, or Firm*—Ingrassia Fisher & Lorenz, P.C.

(57) ABSTRACT

A rotary body for use in a turbo machine includes a hub having an outer edge and a plurality of slots formed in the outer edge, the slots having first and second spaced-apart opposing inner surfaces extending from the outer edge to a depth within the hub, and a plurality of blades secured to the outer edge of the hub, the slots and the blades being arranged such that at least two of the blades are positioned between each pair of adjacent ones of the slots.

20 Claims, 7 Drawing Sheets

ROTARY BODY FOR TURBO MACHINERY WITH MISTUNED BLADES

TECHNICAL FIELD

The present invention generally relates to turbo machinery, and more particularly relates to a rotary body with mistuned blades.

BACKGROUND

Various types of vehicles, such as jet airplanes and helicopters, utilize turbine engines as a primary power source for locomotion or auxiliary power sources. Turbine engines may include a compressor section, in which inlet air is compressed, followed by a combustor section in which fuel is combusted with the compressed air to generate exhaust gas. The exhaust gas is then directed to a turbine section, wherein energy is extracted from the exhaust gas, typically using multiple rotating disks with blades integrally attached, or "blisks," connected to a common bearing and/or shaft.

During the operation of the turbine engines, due to various forces and vibrations, the blades on the blisks often vibrate or oscillate. Multiple blades, or other portions of the blisks, may oscillate at the same frequency, or very similar frequencies, depending on manufacturing tolerances. This synchronous action greatly increases the stresses experienced by the blades and the blisks as a whole. Over time, this can fatigue the blisks, especially the joints between the disks and the blades, which results in the blisks having to be repaired or replaced.

Accordingly, it is desirable to provide rotary body that is designed to minimize the stresses that are experienced during operation of a turbine engine. Furthermore, other desirable features and characteristics of the present invention will become apparent from the subsequent detailed description and the appended claims, taken in conjunction with the accompanying drawings and the foregoing technical field and background.

BRIEF SUMMARY

A rotary body for use in a turbo machine is provided. The rotary body includes a hub having an outer edge and a plurality of slots formed in the outer edge, the slots having first and second spaced-apart opposing inner surfaces extending from the outer edge to a depth within the hub, and a plurality of blades secured to the outer edge of the hub, the slots and the blades being arranged such that at least two of the blades are positioned between each pair of adjacent ones of the slots.

A rotary body for use in a turbo machine is provided. The rotary body includes a substantially circular disk having first and second opposing sides, an outer edge interconnecting the first and second sides, and a plurality of slots formed in the outer edge, and a plurality of blades secured to the outer edge of the disk, the slots and the blades being arranged such that at least two of the blades are positioned between each pair of adjacent ones of the slots and each slot is positioned between a pair of adjacent ones of the blades, each slot being a first distance from a first blade of the respective pair of adjacent blades and a second distance from a second blade of the respective pair of adjacent blades, the second distance being greater than the first distance.

A method for constructing a rotary body for use in a turbo machine is provided. A substantially circular disk having first and second opposing surfaces and an outer edge interconnecting the first and second opposing surfaces is provided. A plurality of blades having first and second opposing, curved surfaces are secured to the outer edge of the disk such that the blades are substantially evenly spaced-apart. A plurality of slots are formed in the outer edge of the disk such that at least two of the blades are positioned between each pair of adjacent ones of the slots and each slot is positioned between a pair of adjacent ones of the blades, each slot being a first distance from a first blade of the respective pair of adjacent blades and a second distance from a second blade of the respective pair of adjacent blades, the second distance being greater than the first distance.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-7 are merely illustrative and may not be drawn to scale.

FIG. 1 to FIG. 7 illustrate a rotary body for use in a turbo machine. The rotary body includes a hub having an outer edge and a plurality of slots formed in the outer edge, the slots having first and second spaced-apart opposing inner surfaces extending from the outer edge to a depth within the hub, and a plurality of blades secured to the outer edge of the hub, the slots and the blades being arranged such that at least two of the blades are positioned between each pair of adjacent ones of the slots. Each slot may be positioned between adjacent blades and be a first distance from a first of the adjacent blades and a second distance from a second of the adjacent blades. The slots and blades may further be arranged such that less than four blades are positioned between each pair of adjacent slots.

Figure 1:
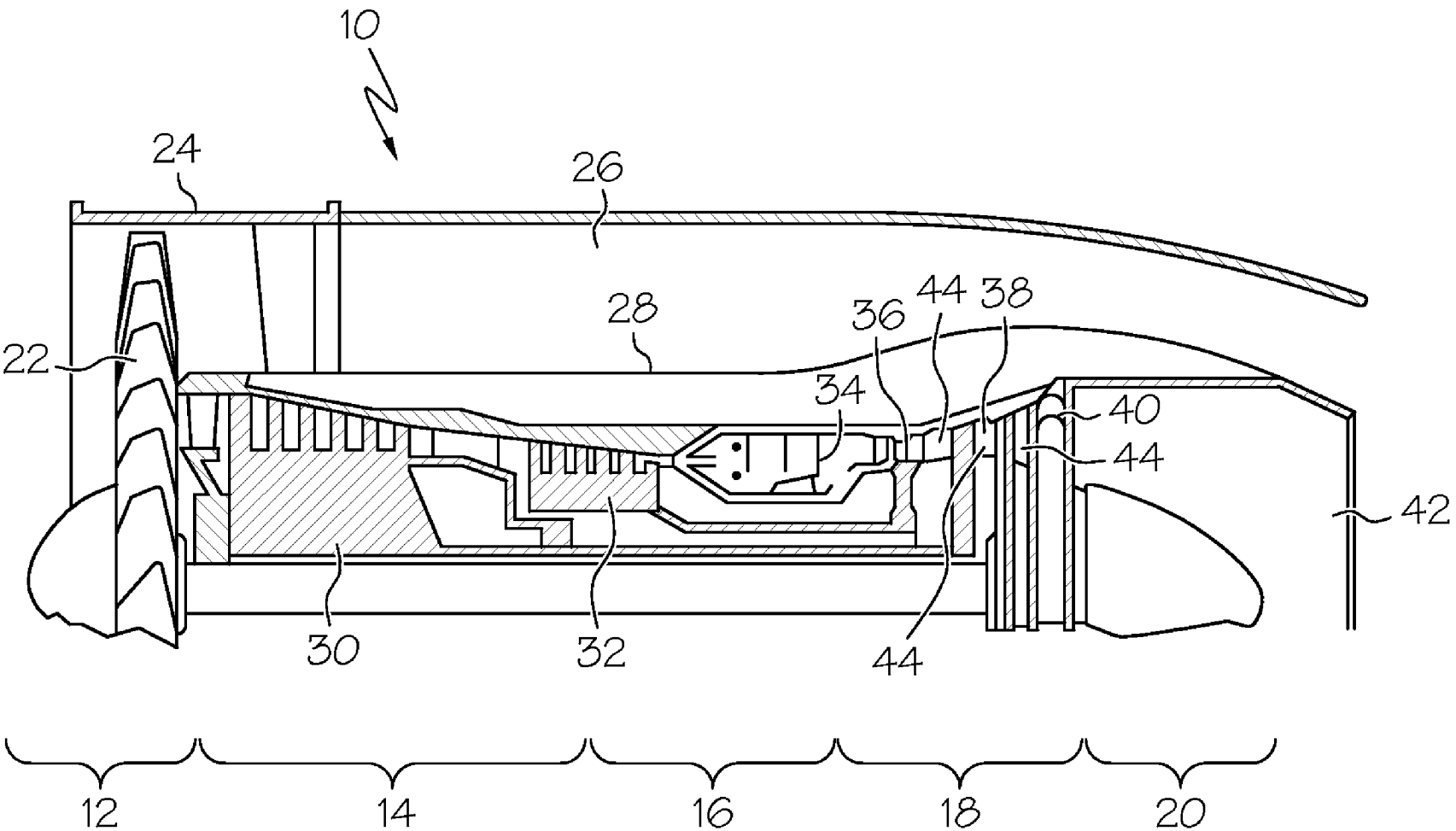
FIG. 1 is a partial cross-sectional view of a jet engine, according to one embodiment of the present invention.
Figure 2:
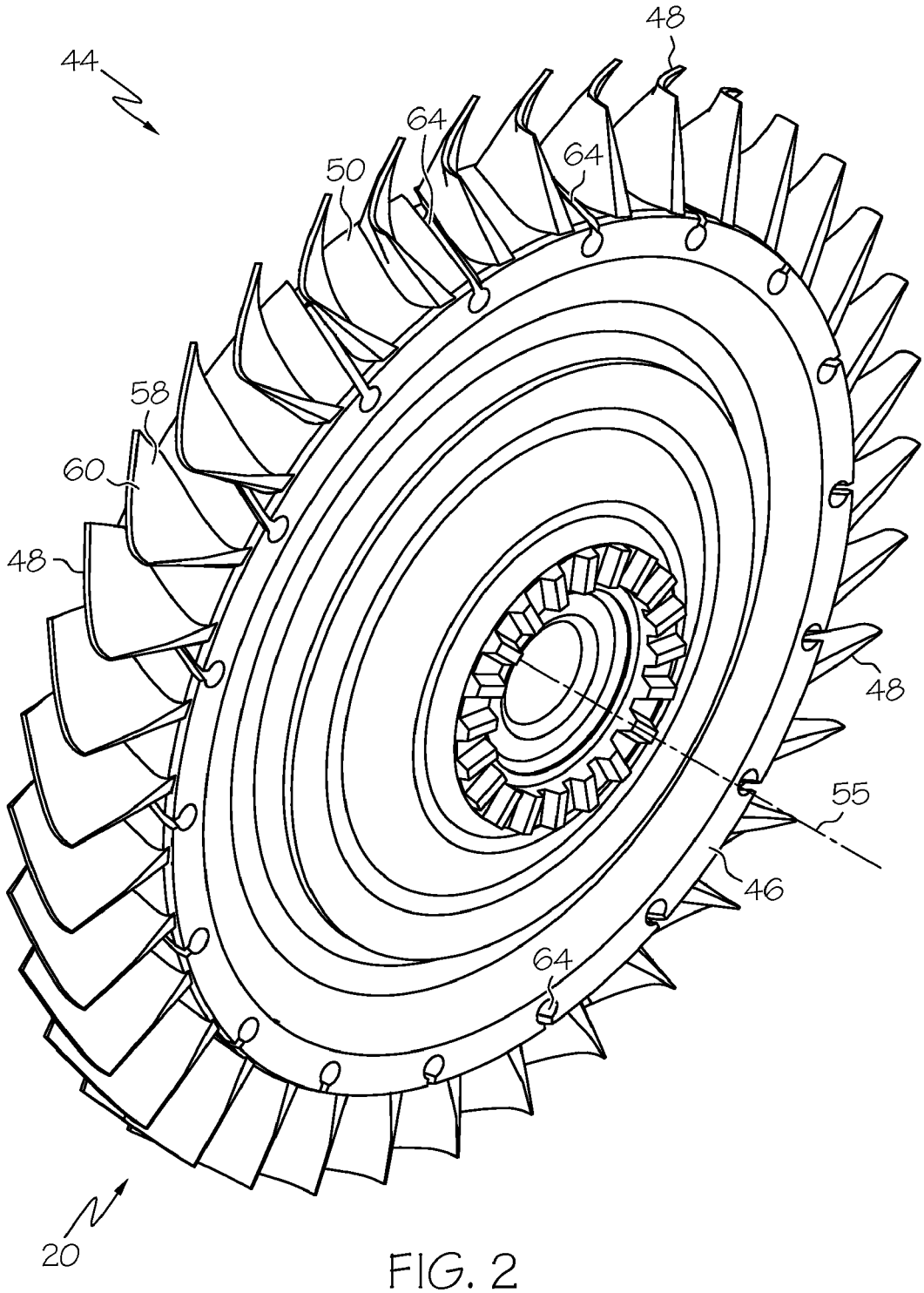
FIG. 2 is an isometric view of a blisk within the jet engine of FIG. 1.

FIG. 1 illustrates a multi-spool turbofan gas turbine jet engine 10 according to one embodiment of the present invention. The jet engine 10 includes an intake section 12, a compressor section 14, a combustion section 16, a turbine section 18, and an exhaust section 20. The intake section 12 includes a fan 22, which is mounted in a fan case 24. The fan 22 draws air into the intake section 12 and accelerates it. A fraction of the accelerated air exhausted from the fan 22 is directed through a bypass section 26 disposed between the fan case 24 and an engine cowl 28, and provides a forward thrust. The remaining fraction of air exhausted from the fan 22 is directed into the compressor section 14.

In the depicted embodiment, the compressor section 14 includes two compressors, an intermediate pressure compressor 30 and a high pressure compressor 32. The intermediate pressure compressor 30 raises the pressure of the air directed from the fan 22 and directs the compressed air into the high pressure compressor 32. The high pressure compressor 32 further compresses the air and directs the high pressure air into the combustion section 16. In the combustion section 16, which includes a plurality of combustors 34, the high pressure air is mixed with fuel and combusted. The combusted air is then directed into the turbine section 18.

Still referring to FIG. 1, the turbine section 18 includes a high pressure turbine 36, an intermediate pressure turbine 38, and a low pressure turbine 40, which are disposed in an axial flow series. The combusted air from the combustion section 16 expands through each turbine, causing it to rotate. The air is then exhausted through a propulsion nozzle 42 disposed in the exhaust section 20, providing additional forward thrust. Although not specifically shown, as the turbines rotate, each drives equipment in the engine 10 via concentrically disposed shafts or spools.

Each of the turbines 36, 38, and 40 includes various integrated bladed disks (or "blisks") 44, such as one or more sets of moveable rotor blisks and one or more sets of fixed stators. Although not shown in detail, in the depicted embodiment, the high pressure turbine 36 includes one set of moveable rotor blisks and one set of fixed stators (only one shown). Similarly, the intermediate pressure turbine 38 includes one set of moveable rotor blisks and one set of fixed stators. The low pressure turbine 40, however, includes three sets of moveable rotor blisks and three sets of fixed stators.

Figure 3:
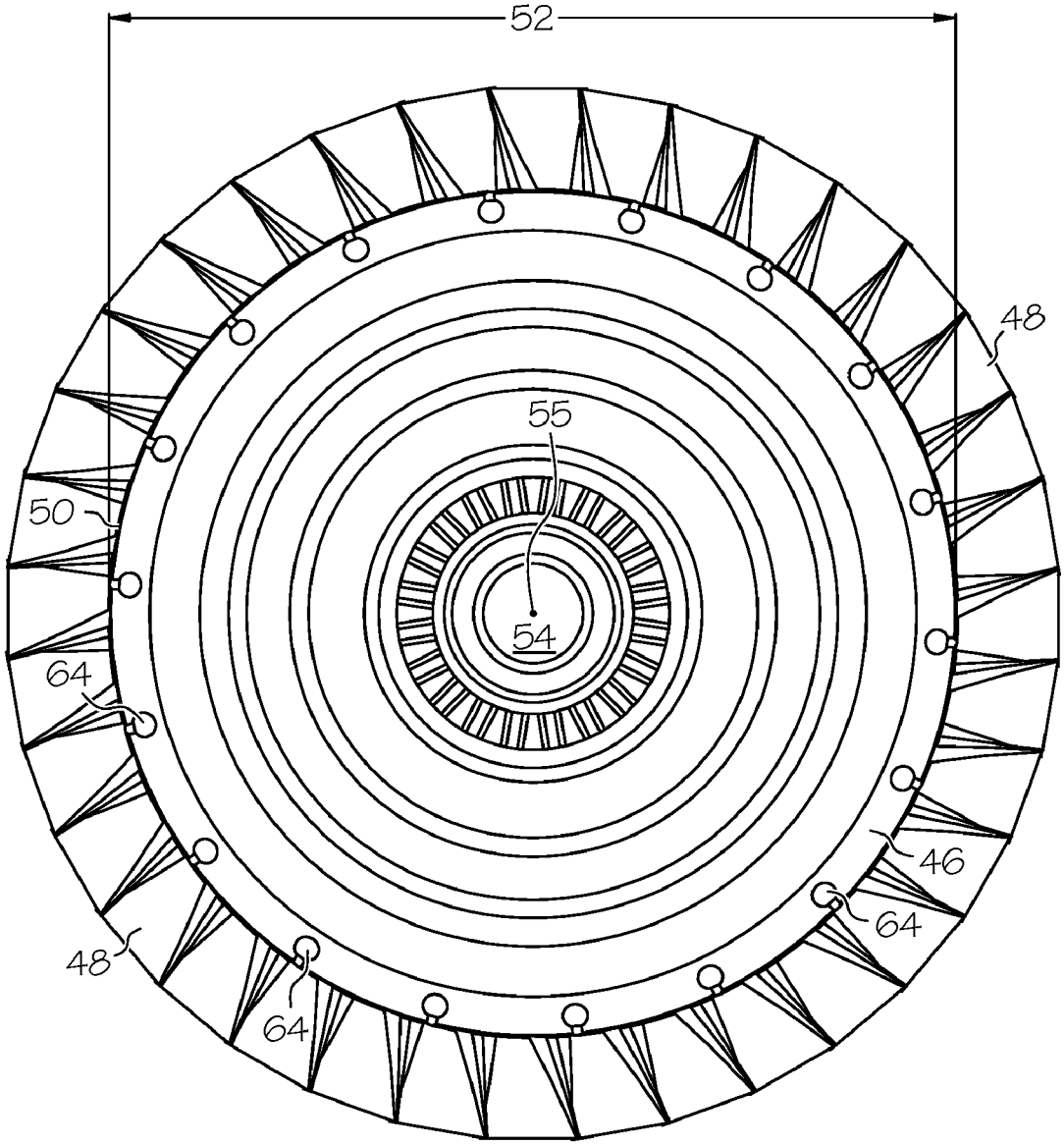
FIG. 3 is a top plan view of the blisk of FIG. 2.
Figure 4:
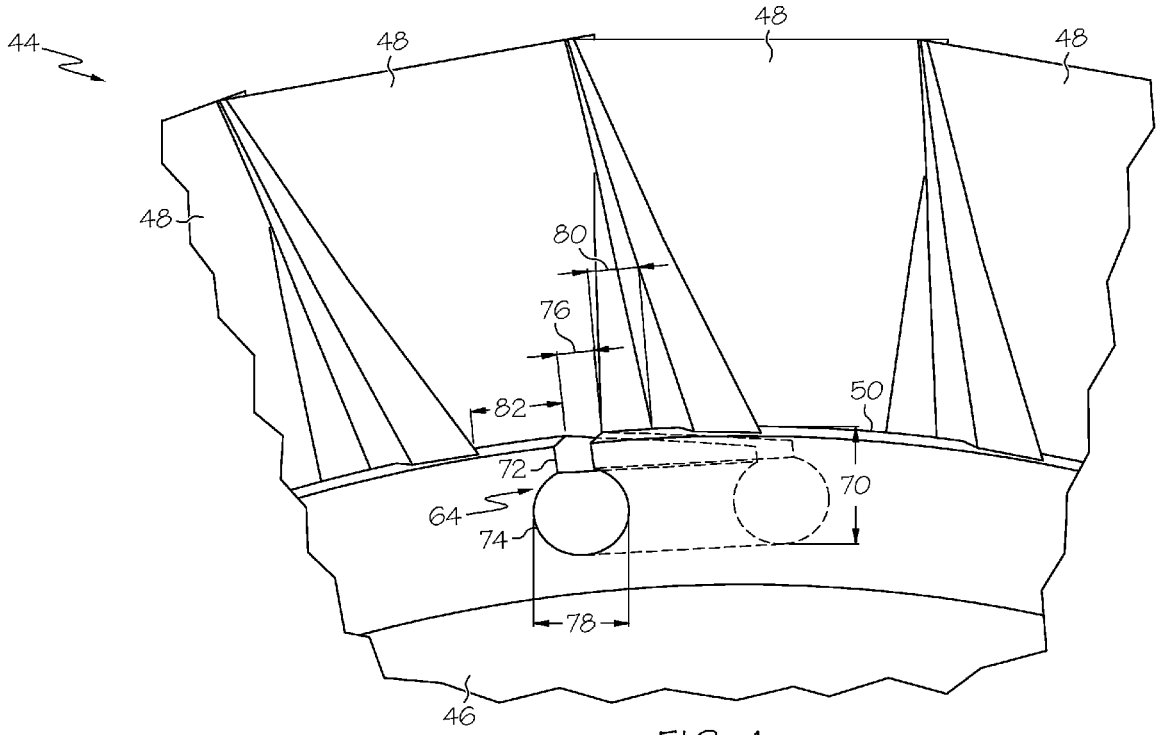
FIG. 4 is a plan view of a portion of the blisk of FIG. 3.
Figure 5:
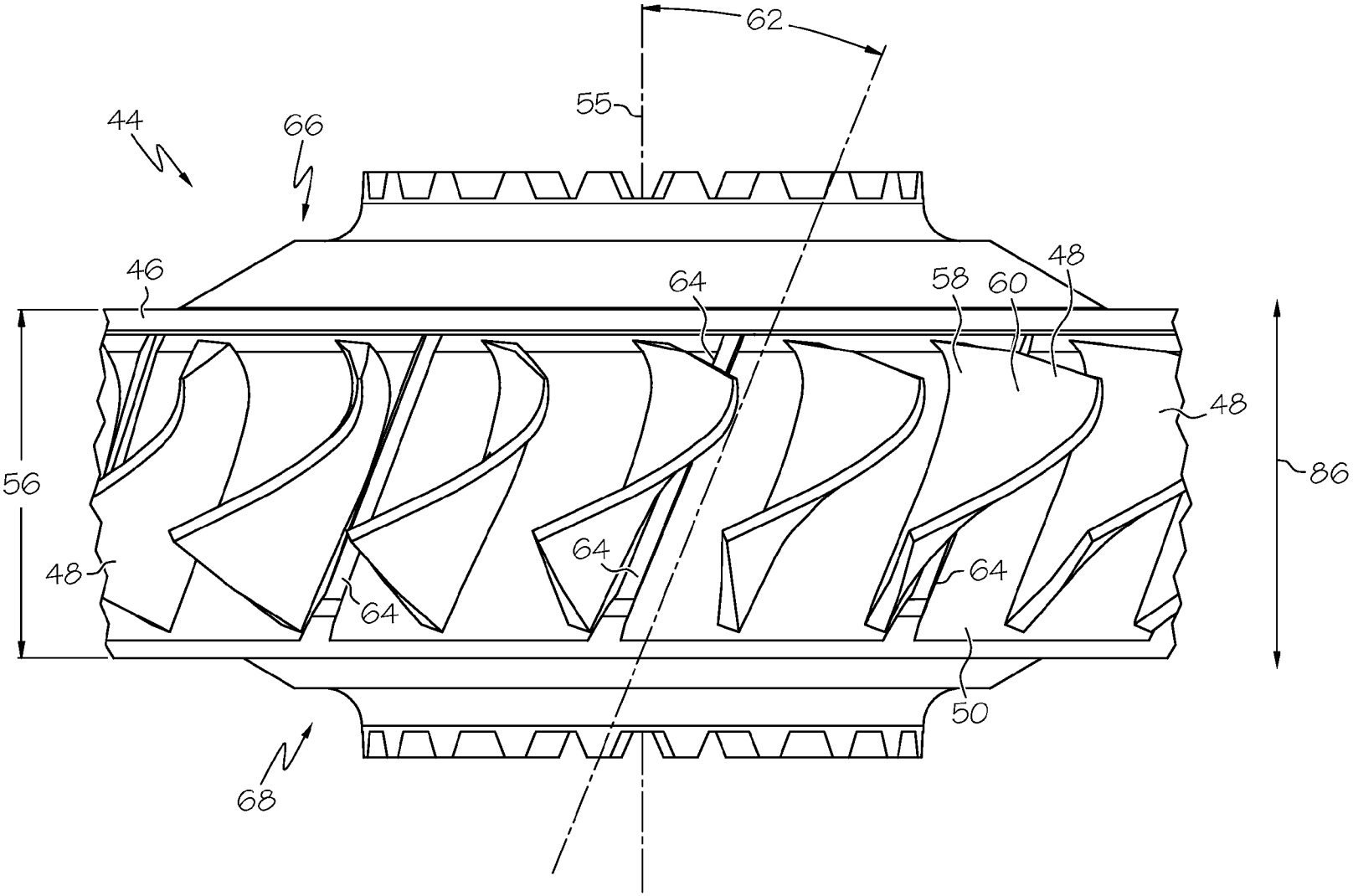
FIG. 5 is a side view of the blisk of FIG. 2.

FIGS. 2-5 illustrate a blisk (or rotary body) 44, according to one embodiment, which may be used in the one or more of the turbine sections 36, 38, and 40 of the jet engine 10 shown in FIG. 1. The blisk 44 includes a disk (or hub) 46 and multiple blades 48. The disk 46 has a substantially circular outer edge 50 with a diameter 52 (e.g., between 12 and 48 inches), a shaft opening 54 (through which a central axis 55 extends) at a central portion thereof, and a thickness 56. The blades 48 are secured to and spaced evenly around the outer edge 50 of the disk 46. In the depicted embodiment, all of the blades are substantially identical, each having an inner portion 58 that is adjacent to the outer edge 50 of the disk 46 and an outer portion 60 that opposes the inner portion 58. The blades 48 have a curved shape with the outer portions 60 have a greater curvature than the inner portions 58. Referring specifically to FIG. 5, the blades 48 substantially extend the entire thickness 56 of the disk 46 and are oriented on the outer edge 50 at an angle 62 relative to the central axis 55.

Still referring to FIGS. 2-5, the blisk 44 also includes a series of slots 64 formed on the outer edge 50 of the blisk 44. As shown specifically in FIGS. 4 and 5, the slots 64 extend the entire thickness 56 of the disk 46 (i.e., extend to opposing sides 66 and 68 of the disk 46) and have a substantially uniform depth 70, as measured from the outer edge 50 towards the central axis 55. Referring to FIG. 4, the slots 64 have a "keyhole" shape when viewed from a direction parallel to the central axis 55, and thus have a rectangular outer (or first) portion 72 and a circular inner (or second) portion 74. As shown, a width 76 of the outer portion is less than a diameter 78 of the inner portion 74. The diameter 78 may be, for example, between 0.1 and 0.5 inches. In one embodiment, the opposing inner sides of the slots 64 do not contact at any point from the outer edge 50 to the depth 70.

Referring to FIGS. 3, 4, and 5, the slots 64 are arranged, for example, such that two of the blades 48 lie between each pair of adjacent slots 64. Likewise, each slot 64 is positioned between a pair of adjacent blades 48, and as shown specifically in FIG. 4, each slot is positioned nearer to one of the blades 48. More specifically, the each slot 64 is positioned a first distance 80 from a first of the adjacent slots 64 and a second distance 82 from a second of the adjacent slots 64. As clearly shown in FIG. 4, the second distance 82 is greater than the first distance 80. In one embodiment, the second distance 82 is at least twice the first distance 80. In another embodiment, the second distance is more than three times greater than the first distance. Referring specifically to FIG. 5, when viewed from a direction that is substantially perpendicular with the central axis 55, the slots 64 are substantially straight and cut into the outer edge 50 of the disk 46 at substantially the same angle 62 at which the blades are oriented, as described above, such that a line that extends through the slot 64 is also at the angle 62 to the central axis 55.

The blisk 44 shown in FIGS. 2-5 may be made of any suitable heat resistant material such as nickel-based alloy for high temperature applications, or titanium for low temperature applications, and may be made in several different ways. The disk 46 and the blades 48 may be investment cast as one piece simultaneously. Alternatively, a thin disk outer rim and the blades 48 may be investment cast as one piece, while the central portion of the disk 46 may be forged or formed by power metallurgy. The two pieces may then be diffusion bonded, or welded, together. Also, large piece of preform material may be machined into the blisk 44 by simply machining off the material between the blades 48.

The slots 64 may be formed by, for example, first drilling holes at the bottom ends of slots (i.e., the inner portions 74 of the slots 64). A radial cut may then be made to form the outer portions 72 of the slots 64. The radial cut may be made by using a laser to cut from the outer edge 50 to the inner portion 74, or vice versa. Also, wired electric discharge machining (EDM), as is commonly understood, may be used to make the radial cut.

During operation of the jet engine 10 (FIG. 1) as described above, the blisk 44 is, at times at least, rapidly rotated about the central axis 55. Due to various forces acting on the blisk 44, as well as vibrations in the jet engine 10, there is a tendency for the blades 48 and/or portions of the disk 46 to oscillate (e.g., in a direction 86 that is substantially parallel to the central axis 55). As will be appreciated by one skilled in the art, the frequency at which each blade 48 and/or portion of the disk 46 oscillates is proportional to the square root of the rigidity (or "stiffness") of the particular blade 48 and/or portion of the disk 46.

The slots 64 formed in the outer edge 50 of the disk 46 vary the supporting stiffness of the blades 48 and/or the different portions of the disk 46. More specifically, referring again to FIG. 4, the blade 48 nearer (i.e., to the right of) the slot 64 experiences a first stiffness, while the blade 48 farther (i.e., to the left of) the slot 64 experiences a second stiffness, which is greater than the first stiffness. As a result, the blade 48 nearer the slot 64 oscillates at a frequency lower than that of the blade 48 farther from the slot 64. The same basic effect occurs around the entire disk 46. Therefore, the number of blades 48 (and/or portions of the disk 46) that oscillate at the same frequency (or nearly the same frequency) is reduced.

One advantage of the rotary body described above is that because the stiffness, and thus the oscillating frequencies, of the blades 48 around the disk 46 is varied, the likelihood that multiple blades 48 will oscillate at the same (or nearly the same frequency) is reduced. Therefore, the amount of stress experienced by the blades 48, and the blisk 44 as a whole, is reduced. As a result, the reliability and longevity of the blisk 44 is improved.

Figure 6:
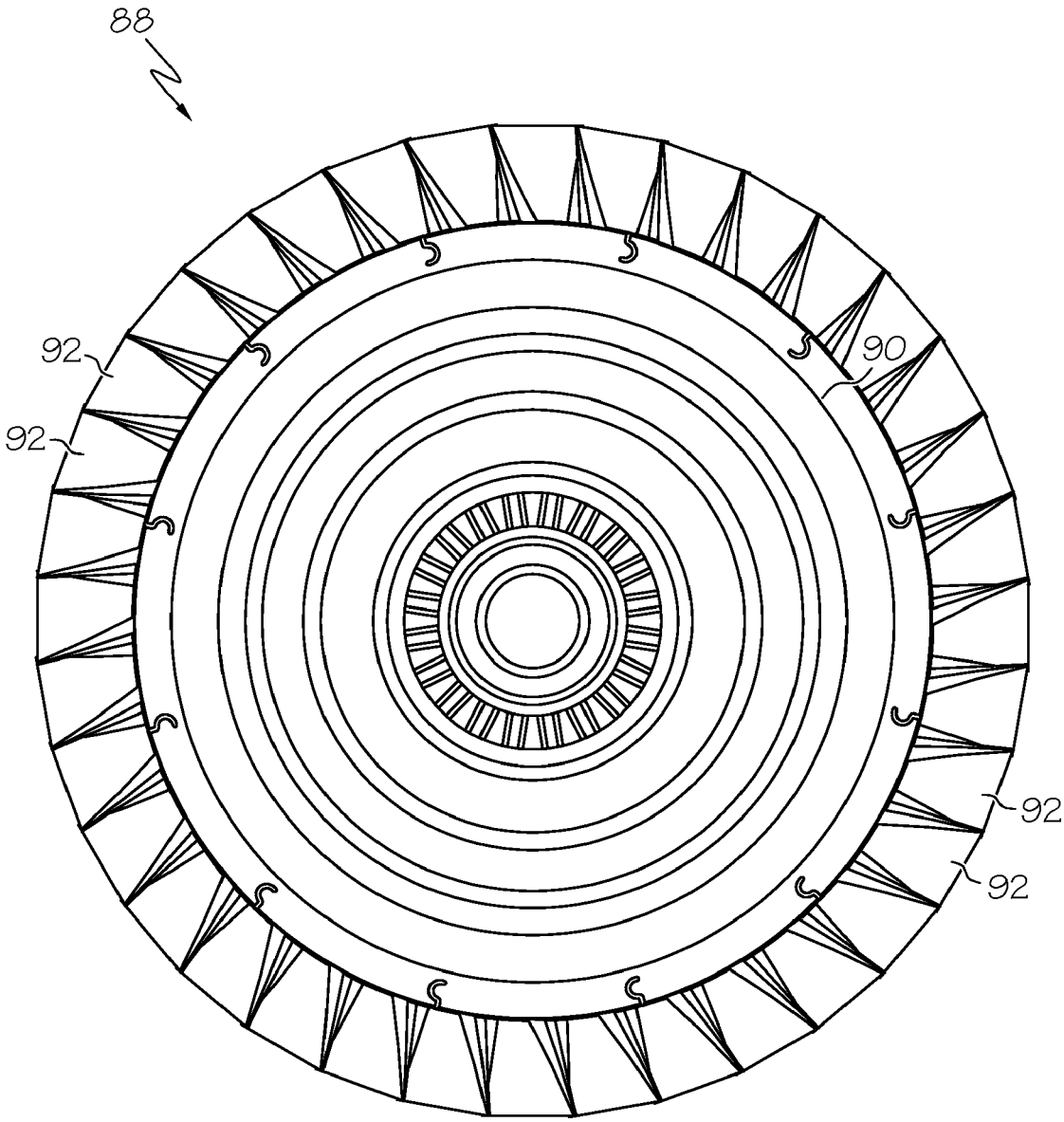
FIG. 6 is a top plan view of a blisk, according to another embodiment of the present invention.
Figure 7:
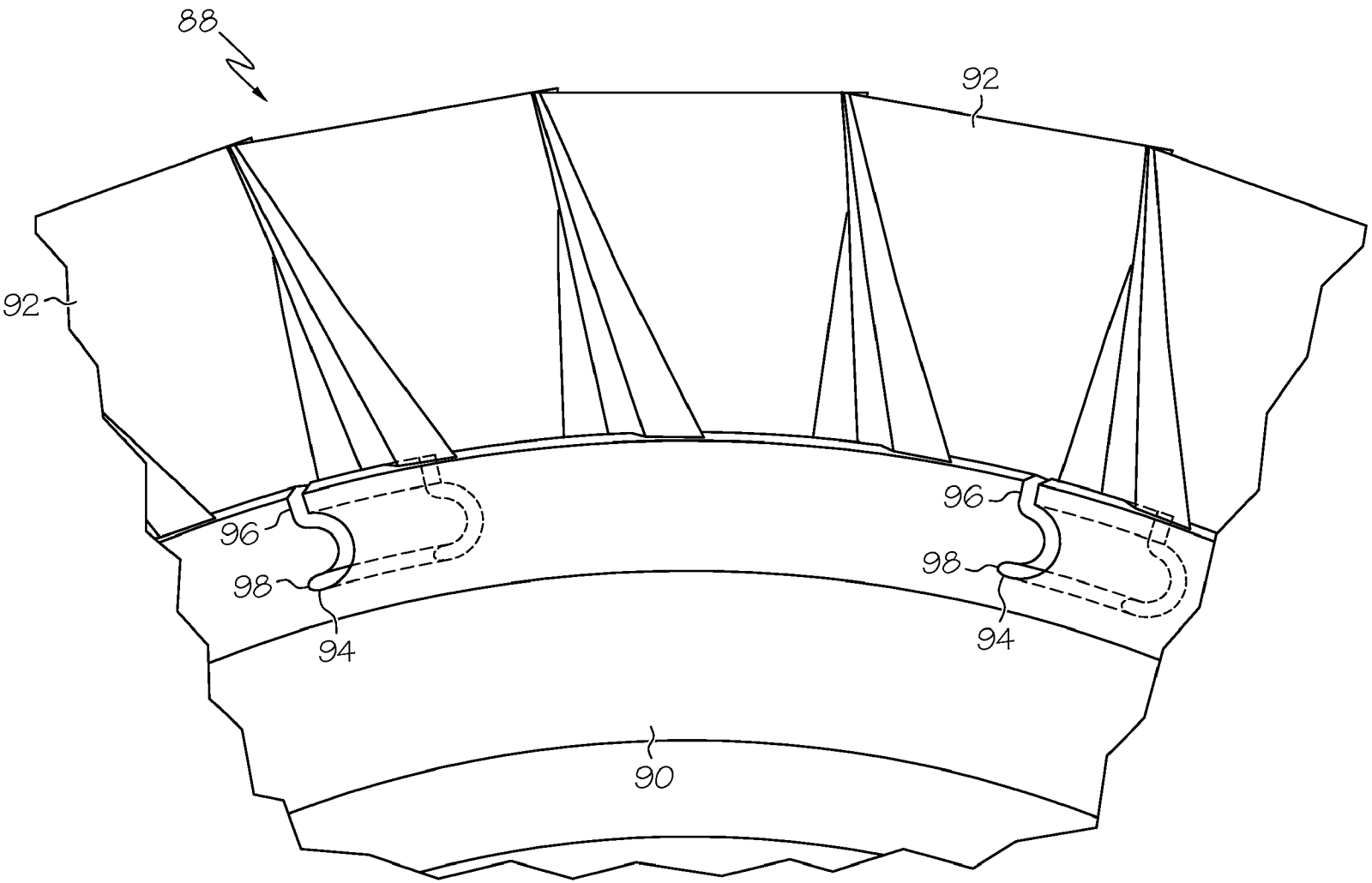
FIG. 7 a plan view of a portion of the blisk of FIG. 6.

FIGS. 6 and 7 illustrate a blisk 88, according to another embodiment of the present invention. The blisk 88 includes a disk 90 and a multiple blades 92 secured to an outer edge of the disk 90, similar to the blisk 44 shown in FIGS. 2-5. The blisk 88 also includes multiple slots 94 formed on the outer edge of the disk 90. However, as shown in FIGS. 6 and 7, the slots 94 are arranged such that three of the blades 92 are positioned between each pair of adjacent slots 94, and the slots 94 have a "J" shape. More specifically, an outer portion 96 of the slots 94 are substantially straight, while an inner portion 98 of the slots 94 are curved. The outer and inner portions 96 and 98 have similar widths. During operation, the slots 94 may function in a manner similar to the slots 64 described above.

Other embodiments may utilize configurations of turbo machinery other than the turbofan turbine jet engine shown in FIG. 1, such as turbojets, turboprops, and turboshafts, which may be installed in various types of vehicles, such as jet and propeller airplanes. Other embodiments may also be used as axial flow compressor blisks and fan blisks. It should also be understood that the rotary body described above may also be used in turbo machinery that is used not only for propulsion purposes, but to generate power, such as in auxiliary power units (APU), as is commonly understood.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A rotary body for use in a turbo machine comprising:

a hub having an outer edge and a plurality of slots formed in the outer edge, the slots having first and second spaced-apart opposing inner surfaces extending from the outer edge to a depth within the hub; and a plurality of blades secured to the outer edge of the hub, the slots and the blades being arranged such that at least two of the blades are positioned between each pair of adjacent ones of the slots.

2. The rotary body of claim 1, wherein the slots and the blades are further arranged such that each slot is positioned between a pair of adjacent ones of the blades.

3. The rotary body of claim 2, wherein each slot is a first distance from a first blade of the respective pair of adjacent blades and a second distance from a second blade of the respective pair of adjacent blades, the second distance being greater than the first distance.

4. The rotary body of claim 3, wherein the hub has first and second opposing sides and the slots extend between the first and second opposing sides of the hub.

5. The rotary body of claim 4, wherein the hub has a central axis and each slot is arranged such that a line extending therethrough and between the first and second opposing sides of the hub is at an angle to the central axis of the hub.

6. The rotary body of claim 5, wherein the slots have a first width at first portions of the first and second opposing inner surfaces thereof and a second width at second portions of the first and second opposing inner surfaces thereof.

7. The rotary body of claim 6, wherein the slots and the blades are arranged such that less than four of the blades are positioned between each pair of adjacent ones of the slots.

8. A rotary body for use in a turbo machine comprising:

a substantially circular disk having first and second opposing sides, an outer edge interconnecting the first and second sides, and a plurality of slots formed in the outer edge; and a plurality of blades secured to the outer edge of the disk, the slots and the blades being arranged such that at least two of the blades are positioned between each pair of adjacent ones of the slots and each slot is positioned between a pair of adjacent ones of the blades, each slot being a first distance from a first blade of the respective pair of adjacent blades and a second distance from a second blade of the respective pair of adjacent blades, the second distance being greater than the first distance.

9. The rotary body of claim 8, wherein each slot has first and second spaced-apart opposing inner surfaces extending from the outer edge to a depth within the disk.

10. The rotary body of claim 9, wherein the second distance is at least twice the first distance.

11. The rotary body of claim 10, wherein the disk has a central axis and each slot is arranged such that a line extending therethrough and between the first and second opposing sides of the disk is at an angle to the central axis of the disk.

12. The rotary body if claim 11, wherein the slots and the blades are arranged such that less than four of the blades are positioned between each pair of adjacent ones of the slots.

13. The rotary body of claim 12, wherein the slots have a first width at first portions of the first and second opposing inner surfaces thereof and a second width at second portions of the first and second opposing inner surfaces thereof.

14. The rotary body of claim 13, wherein each blade as first and second opposing, curved surfaces.

15. A method for constructing a rotary body for use in a turbo machine comprising:

providing a substantially circular disk having first and second opposing surfaces and an outer edge interconnecting the first and second opposing surfaces;

securing a plurality of blades having first and second opposing, curved surfaces to the outer edge of the disk such that the blades are substantially evenly spaced-apart; and forming a plurality of slots in the outer edge of the disk such that that at least two of the blades are positioned between each pair of adjacent ones of the slots and each slot is positioned between a pair of adjacent ones of the blades, each slot being a first distance from a first blade of the respective pair of adjacent blades and a second distance from a second blade of the respective pair of adjacent blades, the second distance being greater than the first distance.

16. The method of claim 15, wherein less than four blades are positioned between each pair of adjacent ones of the slots and the second distance is at least twice the first distance.

17. The method of claim 16, wherein each slot has first and second spaced-apart opposing inner surfaces extending from the outer edge to a depth within the disk.

18. The method of claim 17, wherein the disk has a central axis and each slot is arranged such that a line extending therethrough and between the first and second opposing sides of the disk is at an angle to the central axis of the disk.

19. The method of claim 18, wherein said forming of the plurality of the slots occurs after said securing of the blades to the outer edge of the hub.

20. The method of claim 19, wherein the slots have a first width at first portions of the first and second opposing inner surfaces thereof and a second width at second portions of the first and second opposing inner surfaces thereof.

* * * * *